US005398927A

United States Patent [19]

O'Sullivan

[11] Patent Number: 5,398,927

[45] Date of Patent: Mar. 21, 1995

[54] FLAG POLE WITH DIVOT REPAIR DEVICE

[75] Inventor: Daniel O'Sullivan, Setauket, N.Y.

[73] Assignee: Alpha Logic, Incorporated, Port Jefferson, N.Y.

[21] Appl. No.: 223,516

[22] Filed: Apr. 5, 1994

[51] Int. Cl.[6] ..... A63B 57/00

[52] U.S. Cl. ..... 273/34 R; 273/32 B

[58] Field of Search ..... 273/34 R, 34 A, 34 B, 273/32 B, 162 F, 162 B

[56] References Cited

U.S. PATENT DOCUMENTS

| | | | |
|---|---|---|---|
| 1,744,985 | 1/1930 | Picha | 273/34 R |
| 2,121,270 | 6/1938 | Streich | 273/34 R |
| 2,869,915 | 1/1959 | Good | 294/50.6 |
| 3,168,150 | 2/1965 | Kappler | 294/50.8 |
| 3,771,794 | 11/1973 | Crockett | 273/162 F |
| 3,797,833 | 3/1974 | Rokusek | 273/34 R X |
| 4,273,329 | 6/1981 | Trigg et al. | 273/32 B |
| 4,846,286 | 7/1989 | McNeely et al. | 172/379 |
| 4,884,805 | 12/1989 | Patterson | 172/378 X |
| 4,955,609 | 9/1990 | Kassen | 273/162 F |
| 5,029,854 | 7/1991 | Laskowitz et al. | 273/32 B |
| 5,052,687 | 10/1991 | Katerba | 273/34 R |

*Primary Examiner*—George J. Marlo

*Attorney, Agent, or Firm*—Cohen, Pontani, Lieberman, Pavane

[57] ABSTRACT

A divot repair tool is permanently affixed to the bottom of a flag pin and replaces a standard ferrule. A plunging motion is employed by a user of the divot repair tool. From a standing position, the user grasps the shaft of the flag pin and directs it downward thus causing the divot repair tool to contact the turf in the area of the divot. An outer cylindrical sleeve first contacts the turf and is followed by a blade which is rotated and thrust downward by an internal mechanism. The action of the divot repair tool causes the turf and under lying soil of the divot area to be loosened thus promoting the recovery of the divot area.

8 Claims, 2 Drawing Sheets

FLAG POLE WITH DIVOT REPAIR DEVICE

BACKGROUND OF THE INVENTION

1. Field of the Invention

This invention relates generally to a golf course maintenance device, and more particularly, to a device which may be secured to the base of a flag pole or stick.

2. Brief Description of the Prior Art

Golf is a well established recreational activity enjoyed by Americans and people all over the world. Golf courses, both public and private, are available to most communities through out the country and at each of these courses a significant effort is undertaken to establish and maintain proper facilities. Among the most important considerations in the maintenance of these facilities is the playing surfaces and in particular the putting green itself. It is essential to the game that the putting green surface be free of irregularities which would potentially disrupt the predictable movement of a golf ball directed toward the cup. Such irregularities, however, do arise, and they frequently particularly take the form of a semi-spherical indentation in the turf of the putting green caused by the impact of a golf ball. If unattended to, these indentations or, as they are more commonly referred to, divots, can linger for several days and become a nuisance to other players.

Although many golfers neglect to do so, it is considered good etiquette to repair a divot made by one's own ball by loosening the compacted area of soil and turf corresponding to the divot, which loosening speeds up the recovery of the green. For this purpose, conscientious golfers often carry a pronged tool for lifting up the compacted turf and underlying soil. The pronged tool, which is small enough be carried in the golfer's pocket, is inserted into the turf around the divot and the soil is worked up with a prying motion.

In addition to the small tool described above, a wide variety of other divot repair devices have been proposed. In U.S. Pat. No. 4,273,329, entitled FLAG PIN ATTACHMENT INCLUDING BALL DISTANCE MEASURING LINE AND TURF REPAIR TOOL and issued to Trigg et al. on Jun. 16, 1981, there is proposed a ball distance measuring device which incorporates a divot repair tool. This device is intended to be worn or clipped on to a golf player's clothing. In use, the device is clipped onto a flag pin and a measuring line is played out by pulling a ring member to the location of the ball to be marked. A pair of prong members constitute the divot repair component of the device. To function as a divot repair tool, the attachment must first be removed from the flag stick, since the prong members extend in a direction perpendicular to the longitudinal axis of the flag stick while the device is attached thereto.

Also proposed are divot repair tools securable to a golf club. See, for example, U.S. Pat. No. 4,955,609 to Kassen and U.S. Pat No. 3,771,794 to Crockett. Although such devices permit the golfer to repair a divot from a standing position, they must be specifically dimensioned to accommodate a particular club structure unless special modifications are made. Moreover, depending on conditions such as soil compaction and the like, there is the potential that expensive clubs may be damaged when used in the manner contemplated by the by Kassen and Crockett.

Other devices which have been proposed utilize a rod or tube-like member having a handle at one end and a ground engaging device at the other end. For examples of such devices, reference may be had to U.S. Pat. Nos. 2,869,915, 3,168,150, 4,846,286, 4,884,805, and 5,1029,854. Each of these devices allows the golfer to repair his damage without the need for kneeling to the ground, and thus represent an improvement over the pocket sized pronged tool discussed above. However, because such structures are relatively large and must be carried in the golf bag, they may be impractical for those golfers who do not wish to make a separate trip to retrieve the special-purpose repair tool each time it is needed.

It is therefore an object of the present invention to provide a divot repair tool which is securable to the bottom of a flag stick or pole and which is therefore highly accessible to the user.

It is another object of the present invention to provide a divot repair tool which allows the user to effect a divot repair from an upright, standing position.

It is yet another object of the present invention to provide a tool which is easy to use as well as economical to manufacture.

SUMMARY OF THE INVENTION

The aforementioned object, as well as others which will become apparent to those skilled in the art, are achieved by a tool which promotes the repair of divots in two ways. First, because the tool is secured to the bottom of the flag pole shaft, it is always in close proximity to the divot at hand and to the golfer. Second, the action associated with the repair of a divot is simplified. That is, instead of requiring the golfer to stoop down and pry at the turf, a plunging motion is used with the golfer standing upright and grasping the flag shaft.

Preferably, the divot repair tool of the present invention is rigidly secured to the bottom of the flag shaft and is dimensioned and arranged to replace the conventional ferrule which is typically used to anchor the flag pin to the cup. The mechanism of the tool fits within a cylindrical sleeve which is of the same diameter as the standard ferrule. Importantly, with the pin in its installed position in the cup, the tool is not visible and does not alter the standard relative dimensions between the cup and the flag pin.

A plunging motion is employed by a user of the divot repair tool. From a standing position the user grasps the shaft of the flag pole and directs it downwardly, thereby causing the divot repair tool to contact the turf in the region of the divot. An outer cylindrical sleeve first contacts the turf and is followed by a blade which is rotated and thrust downward by an internal mechanism. The action of the divot repair tool causes the turf and under lying soil of the divot area to be loosened thus promoting the recovery of the divot area.

The various features of novelty which characterize the invention are pointed out with particularity in the claims annexed to and forming a part of the disclosure. For a better understanding of the invention, its operating advantages, and specific object attained by its use, reference should be had to the drawing and descriptive matter in which there are illustrated and described preferred embodiments of the invention.

BRIEF DESCRIPTION OF THE DRAWINGS

The present invention will be better understood by reference to the following detailed description taken in connection with the drawings, in which.

DETAILED DESCRIPTION OF THE PREFERRED EMBODIMENTS

Figure 1:
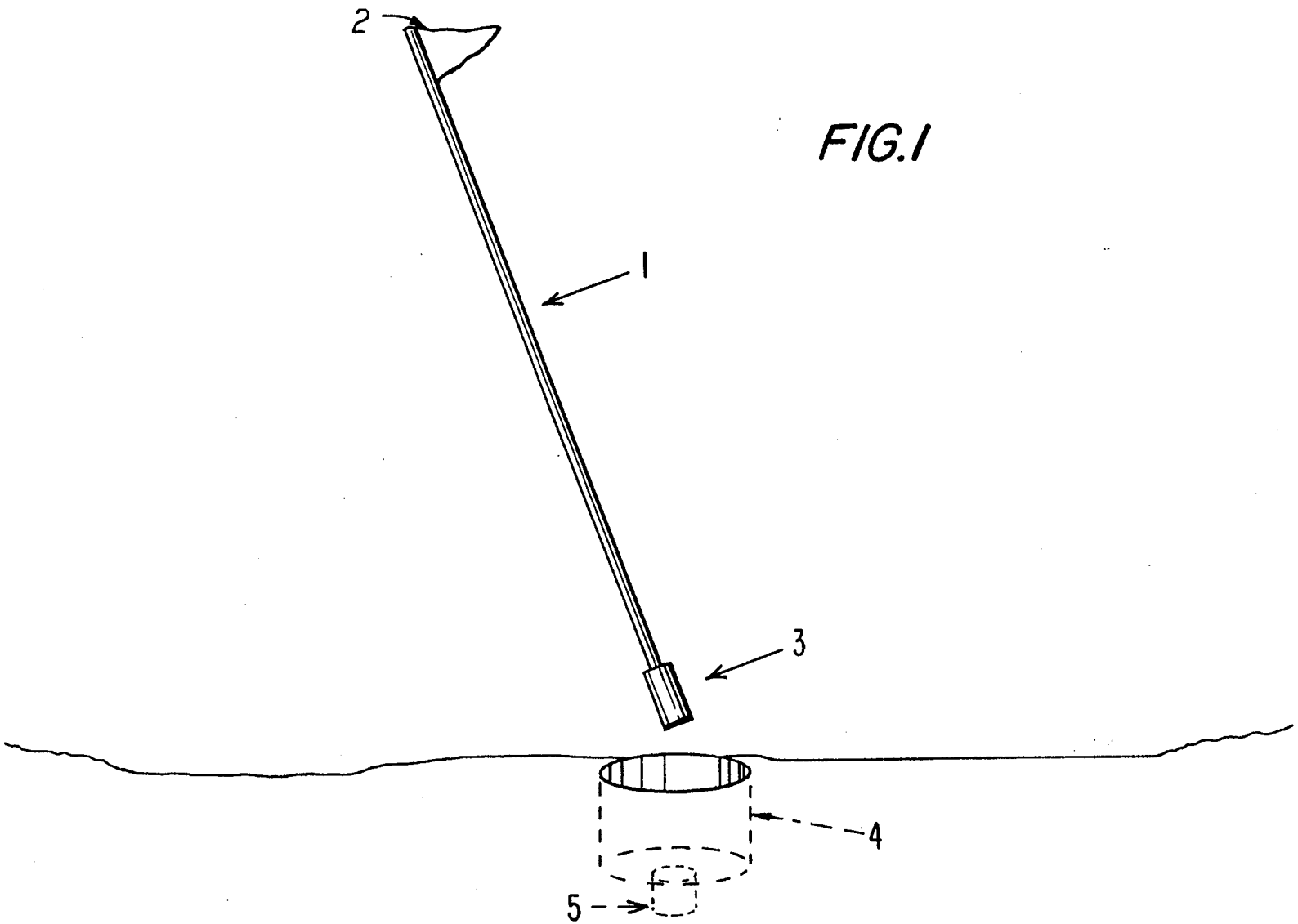
FIG. 1 is a perspective view illustrating a flag pole with a divot repair tool attached thereto in accordance with the present invention.

With initial reference to FIG. 1, there is shown a flag pin comprised of a shaft 1, a flag 2 attached to the upper end region of the shaft, and a divot repair device 3. As will be readily appreciated by those skilled in the art, a golf course cup is typically characterized by an open cavity having a bottom wall in which there is defined a second cavity or center hole 5 of reduced cross section. To accommodate the object of the game, the open cavity of cup 4 is dimensioned to receive one or more golf balls which are directed there during play. A conventional flag pin therefore includes a ferrule secured to the base of the flag shaft and dimensioned and arranged to be inserted into center hole 5 to anchor the flag pin relative thereto. In accordance with a preferred embodiment of the present invention, however, the repair device 3 replaces the standard ferrule and therefore is similarly dimensioned and arranged to accommodate insertion into the lower cavity of the cup. In FIG. 1, the flag pin and repair tool assembly of the present invention are depicted in a removed position. As indicated above, the assembly may be moved into an installed position within the cup by positioning the repair tool 3 in center hole 5.

Figure 2:
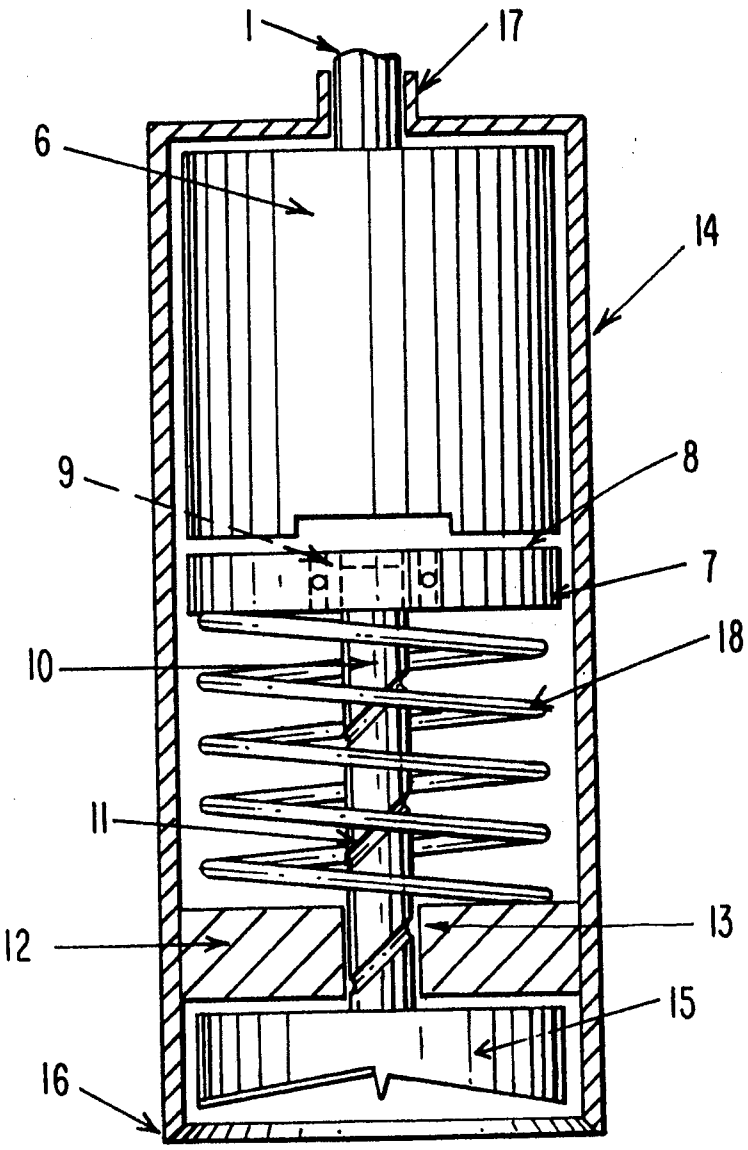
FIG. 2 is a detailed elevation view with the outer housing shown in cross section to show the internal arrangement of elements in a divot repair tool constructed in accordance with the present invention.

With reference now to FIG. 2, there is shown the internal construction of repair device 3. As seen in FIG. 2, the device 3 comprises a cylindrical housing 14 dimensioned to permit insertion into the center hole of a cup, as indicated above. Within housing 14, there is disposed a plunger member rigidly attached or otherwise secured to the base of shaft 1. It should be noted that any suitable means may be utilized to connect plunger member 6 to shaft 1. Thus, for example, a threaded connection, an interference fit, or an adhesive material might be employed to secure the plunger to the base of shaft 1. To facilitate the retrofit of an existing flag pole from which the ferrule has been removed, housing 14 may be configured as a two piece construction in which an apertured upper housing section is slid onto shaft 1 while the plunger member 6 is attached. To facilitate sliding movement of plunger 6 within housing 14, the upper region thereof is equipped with a neck section 17 which is slidably fitted to the shaft 1. The cylindrical sleeve of the illustrative embodiment depicted in FIG. 2 is also provided with at least one grip tooth 16 along it's bottom edge.

In any event, as seen in FIG. 2, plunger 6 rests on the upper surface 8 of an axial bearing 7. A rotor shaft 10, which is affixed at its upper end to the inner rotatable member 9 of bearing 7, is equipped with a spiral groove 11. Rotor shaft 10 is constrained from other than rotational movement by an internally threaded stator disk 12 fixed within the interior of housing 14. For this purpose, the internal threading 13 of stator disk 12 is dimensioned and arranged to mate with spiral groove 11. A rotor blade 15 is affixed to the lower end of rotor shaft 10 and is adapted to rotate therewith, in a manner to be described below.

Operation of the repair tool of the present invention to repair a divot will now be described with simultaneous reference to FIGS. 1 and 2. Initially, it is necessary to remove the flag pin assembly from the center hole 5 of cup 4. A user standing in an upright position may then grip said shaft 1 with one or two hands so that the repair tool 3 is located over a divot. With a plunging motion, the user will impact said flag pin assembly into the divot such that repair tool 3 encounters the divot squarely. When the lower peripheral edge of cylindrical housing 14 engages the turf, grip tooth 16 prevents rotational motion of the housing 14.

As the user continues to apply pressure in a downward direction along the longitudinal axis of the shaft 1, the shaft is caused to slide within the neck 17 of housing 14. As a result, plunger 6 is caused to slide in the same direction within the housing, which in turn places downward pressure on bearing 7. The downward pressure of bearing 7 causes rotating member 9 and rotor shaft 10 to move downward as they rotate, with rotor shaft 10 being forced downward along its longitudinal axis and groove 11 being forced to encounter thread 13 of stator disk 12.

As indicated above, rotor blade 15 is affixed to the lower end of rotor shaft 10. As such, upon rotation and downward movement of rotor shaft 10, blade 15 translates downwardly as it rotates therewith. Continued downward translation of and rotation of blade 15 causes the same to encounter and penetrate the turf in the divot area surrounded by housing 14. As will be readily appreciated by those skilled in the art, penetration and working of the divot area by blade 15 and will have the effect of loosening the turf and soil underlying the divot area. A coil spring 18 is located around rotor shaft 10 and is held in a compressed state between the bearing 7 and stator disk 12. Spring 18 provides an upward bias which urges the rotor shaft 10 and all adjoining components upwardly and returns the same to the initial position depicted in FIG. 2 upon relief of the pressure applied by the user.

Those skilled in the art will know that certain modifications to the preferred embodiment described above could be incorporated without changing the spirit of the invention. For example, in accordance with alternate embodiment of the present invention, the divot repair tool attached to the bottom of a flag pin is configured as a rigid member which has incorporated two pronged members extending in the direction of the longitudinal axis of the flag pin for the purpose of penetrating and lifting turf surfaces. In order to effect a divot repair the user would remove the flag stick from the cup and, from an upright standing position, grasping the shaft of the flag pin, cause the prongs of the attached repair tool to penetrate the perimeter of the divot. A rocking motion of the shaft of the flag pin would then cause the turf and the underlying soil of the divot to be loosened.

In accordance with yet another embodiment of the present invention, the repair device, which is also attached to the bottom of the shaft of the flag pin, is configured as a flat blade which extends below a standard ferrule. The repair device constructed in accordance with this embodiment utilizes a blade provided with a plurality of small rigid bristles which extend from the blade in an upward and outward direction. If forced in an upward direction, each bristle will be easily bent to lay in direction parallel to the blade. If forced in a downward direction, however, each bristle will bend to a position no further than perpendicular to the blade. In order to effect a repair, the user will employ a plunging motion from an upright position, in a manner described in the first embodiment, directing the repair tool into the center of the divot. The repair tool is then upwardly removed, thus engaging said bristles into the turf and underlying soil and causing same to be lifted and loosened.

In view of the foregoing, it will be readily appreciated that the invention is not limited by the embodiments described above which are presented as examples only but can be modified in various ways within the scope of protection defined by the appended patent claims.

What is claimed is:

1. A divot repair apparatus for use on a golf course having a plurality of cups each defining a central hole therein, said apparatus comprising:

a flag pin assembly having a shaft and a flag secured to an upper portion of the shaft; and a divot repair assembly dimensioned and arranged to be received within said central hole, said divot repair assembly being secured to a lower end of said shaft and being adapted to anchor said flag pin assembly within a corresponding cup when positioned with said central hole, said divot repair assembly including at least one ground penetrating member extending in a direction parallel to the longitudinal axis of the shaft, and a cylindrical housing defining an interior cavity, said housing containing said ground penetrating member and having a cross sectional profile corresponding to said central hole and being positionable therewithin such that an exterior portion thereof is supported by said cup.

2. The apparatus of claim 1, wherein said cylindrical housing comprises an axial hole at one end for receiving the flag shaft.

3. The apparatus of claim 2, wherein said divot repair assembly further comprises a plunger member slidably disposed within said housing and secured to the lower end of the flag shaft, said at least one ground penetrating member being vertically movable in response to sliding movement of said plunger member.

4. The apparatus of claim 3, wherein said divot repair assembly further comprises rotating means for rotating said ground penetrating member in response to sliding movement of said plunger member.

5. The apparatus of claim 3, wherein said rotating means comprises an internally threaded stator disk disposed within said housing, a matingly threaded rotating shaft disposed within said stator disk, and a bearing member positioned between an upper end of said rotating shaft and a lower surface of said plunger member, and wherein said ground penetrating member comprises a blade secured to a lower end of said rotating shaft and adapted to rotate therewith in response to downward movement of said plunger.

6. The apparatus of claim 1, wherein said divot repair assembly comprises two prong members coupled to said flag shaft, whereby a divot may be repaired by grasping said flag shaft to remove said divot repair assembly from the central hole and positioning the prong members into penetrating engagement with a ground region corresponding to the divot.

7. The apparatus of claim 1, wherein said ground penetrating member comprises a blade projecting from a lower surface of said cylindrical member.

8. The apparatus of claim 7, further including a plurality of rigid bristles biased to move in a predetermined direction.

* * * * *